US007358940B2

(12) United States Patent
Aoki

(10) Patent No.: US 7,358,940 B2
(45) **Date of Patent: *Apr. 15, 2008**

(54) ELECTRO-OPTICAL DEVICE, CIRCUIT FOR DRIVING ELECTRO-OPTICAL DEVICE, METHOD OF DRIVING ELECTRO-OPTICAL DEVICE, AND ELECTRONIC APPARATUS

(75) Inventor: Toru Aoki, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 575 days.

This patent is subject to a terminal disclaimer.

(21) Appl. No.: 11/017,036

(22) Filed: Dec. 21, 2004

(65) Prior Publication Data

US 2005/0156820 A1 Jul. 21, 2005

(30) Foreign Application Priority Data

Jan. 15, 2004 (JP) ..... 2004-008513

(51) Int. Cl.
*G09G 3/36* (2006.01)

(52) U.S. Cl. ..... 345/77; 345/84; 345/87; 345/89; 345/90; 345/690; 315/169.1; 315/169.3; 315/169.4

(58) Field of Classification Search ..... 345/77, 345/87–100, 204, 260, 690, 211–213, 60, 345/63

See application file for complete search history.

(56) References Cited

U.S. PATENT DOCUMENTS 5,289,282 A * 2/1994 Tsuji et al. ..... 348/624
6,894,666 B2 * 5/2005 Otawara et al. ..... 345/77
7,113,227 B1 * 9/2006 Kakuya et al. ..... 348/678
2005/0104829 A1 * 5/2005 Aoki ..... 345/89

FOREIGN PATENT DOCUMENTS

JP A 10-171421 6/1998
JP A 11-337910 12/1999
JP A 2002-116735 4/2002

* cited by examiner

*Primary Examiner*—Howard Hjerpe
*Assistant Examiner*—Jennifer T Nguyen
(74) *Attorney, Agent, or Firm*—Oliff & Berridge, PLC

(57) ABSTRACT

There is provided a circuit for driving an electro-optical device having a precharge voltage generating circuit. The precharge voltage generating circuit has a subtracter for obtaining a difference between a gray scale level of each of pixels which is disposed along one of scanning lines and a reference gray scale previously set, an integrator for integrating the subtraction result for the pixels of one row which are disposed along the one of the scanning lines, an adder for adding a reference value of a precharge voltage to the integrated value, a D/A converter for converting a voltage corresponding to the added result into an analog signal, and an inversion circuit for outputting a precharge signal Vpre which is obtained by inverting the analog signal corresponding to writing polarity. And then, after the one of the scanning lines is selected and prior to selecting the next scanning line, the precharge signal Vpre is applied to data lines, such that the data lines are precharged with the voltage of the precharge signal Vpre. As a result, the deterioration of display quality caused by the horizontal crosstalk can be prevented.

7 Claims, 12 Drawing Sheets

ELECTRO-OPTICAL DEVICE, CIRCUIT FOR DRIVING ELECTRO-OPTICAL DEVICE, METHOD OF DRIVING ELECTRO-OPTICAL DEVICE, AND ELECTRONIC APPARATUS

BACKGROUND

The present invention relates to an electro-optical device, in which deterioration of the display quality caused by so-called horizontal crosstalk can be prevented, a circuit for driving the electro-optical device, a method of driving the electro-optical device, and an electronic apparatus.

Generally, in a liquid crystal panel, which provides a desired display using an optical change of an electro-optical material such as liquid crystal, the liquid crystal is interposed between a pair of substrates. Such liquid crystal panels can be classified into several types depending upon a driving method. For example, in an active matrix type driving method, in which pixels are driven by three-terminal switching elements, a configuration described below is provided. Of a pair of substrates constituting such a liquid crystal panel, a plurality of scanning lines and a plurality of data lines are provided so as to intersect with each other on one of the substrates. A pair of a three-terminal switching element such as a thin-film transistor and a pixel electrode is provided formed at each of intersections of the scanning lines and the data lines. Peripheral circuits for driving the scanning lines and the data lines are provided around a region in which the pixel electrodes are provided (display region). On the other substrate, a transparent counter electrode (common electrode) opposing the pixel electrodes is provided, which is maintained at a constant voltage. Further, on the opposing surfaces of the substrates, alignment films which have been rubbed so that the longitudinal axis of the liquid crystal molecules are gradually twisted between the substrates, for example, by approximately 90 degrees. In addition, on the outer surfaces of the substrates, polarizers corresponding to the alignment directions are provided, respectively.

Each of the switching elements provided at the intersections of the scanning lines and the data lines is turned on when a scanning signal applied to the associated scanning line becomes active level, supplying an image signal sampled by an associated data line to the pixel electrode. Thus, to a liquid crystal capacitor formed of the pixel electrode, the counter electrode, and the liquid crystal interposed between the pixel electrode and the counter electrode, a voltage difference between the voltage on the counter electrode and the voltage of the image signal is applied. Even if the switching element is turned off thereafter, the liquid crystal capacitor maintains the voltage difference already applied due to its own capacitance and the capacitance of a storage capacitor.

Light passing between the pixel electrode and the counter electrode is rotary (circularly) polarized by approximately 90 degrees corresponding to a twist of the liquid crystal molecules if the effective voltage applied across the two electrodes is zero. As the effective voltage increases, the liquid crystal molecules tilt toward the direction of the electric field, which results in loss of the optical rotatory. Thus, for example, in a transmissive type liquid crystal display, when polarizers in which polarization axes are orthogonal to each other corresponding to the alignment directions respectively are formed on an incident side and a back side (in a normally white mode), and when the effective voltage applied across the two electrodes is zero, light is transmitted and white is displayed (transmittance is large).

As the effective voltage applied across the two electrodes increases, transmitting light is blocked and finally black is displayed (transmittance is small). Accordingly, a predetermined display can be performed by controlling the voltage applied to the pixel electrode for every pixel.

However, the above-mentioned liquid crystal panel suffers from the problem of deterioration of the display quality caused by so-called horizontal crosstalk. The horizontal crosstalk herein refers to the case in which, when a rectangular black region is displayed in a window over a gray background in the normally white mode, for example, as shown in FIG. 12, a gray region on the right (in a horizontal scanning direction) of the black region becomes brighter (or darker as the case may be) than the original gray color, and then gradually returns to the original gray color. In FIG. 12, a gray scale is represented by the line density of oblique lines (the same is applied to FIG. 13).

Such a horizontal crosstalk may be solved up to a certain degree by a technology in which a swing potential on the counter electrode is added to the image signal which is supplied to the pixel electrode.

However, the above-mentioned horizontal crosstalk may be suppressed up to a certain degree, but another horizontal crosstalk is generated. The horizontal crosstalk refers to the case in which, when the black region is displayed in the window over the gray background, for example, as shown in FIG. 13, in a region which is adjacent to the black region in a horizontal direction among the region of the gray background, a region displaced by one row in a vertical scanning direction becomes brighter than the black region.

SUMMARY

The present invention is made in consideration of the above-mentioned problems, and it is an object of the present invention to provide an electro-optical device, in which the generation of the above-mentioned new horizontal crosstalk can be suppressed and the high quality display can be performed, a circuit for driving the electro-optical device, a method of driving the electro-optical device, and an electronic apparatus.

In order to achieve the above-mentioned objects, there is provided a circuit for driving an electro-optical device according to the present invention, the electro-optical device having pixels, each pixel having a pair of a switching element and a pixel electrode formed at each of intersections of a plurality of scanning lines and a plurality of data lines, the switching element being inserted so as to electrically switch between the data line and the pixel electrode and being turned on when the scanning line is selected, and the pixel electrode opposing a counter electrode with an electro-optical material interposed therebetween. The circuit for driving an electro-optical device comprises a scanning line driving circuit for sequentially selecting the scanning lines, a data line driving circuit for supplying the data lines with image signals according to gray scale levels of the pixels in association with the intersections of the scanning lines and the data lines, when one of the scanning lines is selected, and a precharge circuit for integrating a difference between a gray scale level of each of the pixels in association with the one of the scanning lines and a reference gray scale level previously set for some or all of the pixels of one row which are disposed along the one of the scanning lines, and, prior to supplying the data lines with image signals of the pixels in association with next one of the scanning lines which is selected next to the one of the scanning lines, precharging the data lines with a voltage which corresponds to the integrated value. Since a parasitic capacitance exists on the data line, if the image signal which defines the display content is applied for writing, the voltage which corresponds to the image signal remains behind (is maintained). In the case of the short precharge period, if different voltages remain, the data lines also are precharged with different voltages from each other. To the contrary, according to the present invention, a cumulative value of the difference with the reference gray scale is obtained for one row, and the precharge voltage is determined corresponding to the cumulative value, that is, a deduced remaining voltage. Thus, the precharge voltage of the data line can be prevented from being different for every horizontal scanning period.

In the present invention, the reference gray scale level preferably corresponds to a difference between a maximum value and a minimum value of the gray scale level of the pixel. The reason is as follows. When liquid crystal is used as the electro-optical material, deterioration of display quality is likely to generate in a gray display region where transmittance (or reflectance) largely changes to an effective voltage. In this case, if the gray color corresponding to the difference between the maximum value and the minimum value in the gray scale level of the pixel is selected as the reference gray scale level, a comparison with the reference gray scale level effectively works.

Further, the present invention is not limited to the circuit for driving an electro-optical device. For example, the present invention may be applied to a driving method of an electro-optical device and an electro-optical device itself. In addition, an electronic apparatus according to the present invention has the electro-optical device as a display unit, and thus the generation of the horizontal crosstalk can be suppressed.

DETAILED DESCRIPTION OF EMBODIMENTS

Figure 1:
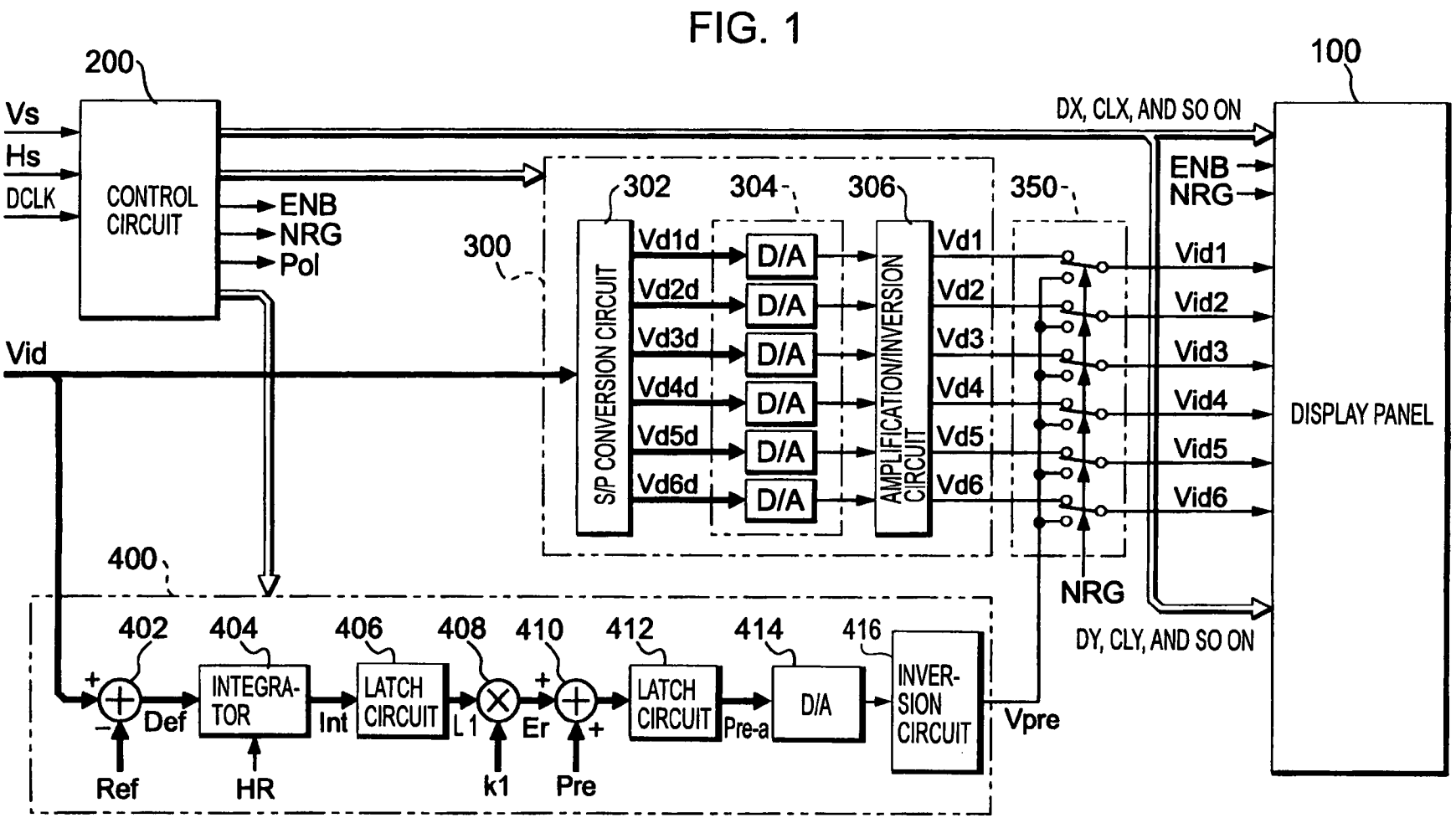
FIG. 1 is a block diagram showing an entire configuration of a liquid crystal display device according to an embodiment of the present invention.

Hereinafter, an embodiment of the present invention will be described with reference to the drawings. FIG. 1 is a block diagram showing a configuration of an electro-optical device according to an embodiment of the present invention.

As shown in FIG. 1, the electro-optical device has a display panel 100, a control circuit 200, a processing circuit 300, a selector 350, and a precharge voltage generating circuit 400. Among them, the control circuit 200 generates timing signals or clock signals that control sections corresponding to a vertical scanning signal Vs, a horizontal scanning signal Hs, and a dot clock signal DCLK, all of which are supplied from a high-level device (not shown).

The processing circuit 300 has a serial-parallel (hereinafter, referred to as 'S/P') conversion circuit 302, a D/A converter group 304, and an amplification/inversion circuit 306.

Among them, upon video data Vid, the S/P conversion circuit 302 divides it into N (N=6 in FIG. 1) channels and extends them N-fold along the time axis (serial-parallel conversion), such that video data Vd1*d* to Vd6*d* are output. Video data Vid is supplied from a high-level device (not shown) in synchronization with the vertical scanning signal Vs, the horizontal scanning signal Hs, and the dot clock signal DCLK. That is, Video data Vid is supplied in serial in synchronization with vertical scanning and horizontal scanning. Video data Vid is converted from serial to parallel to ensure sufficient sample and hold time and charging and discharging time by elongating the time the image signal is applied to sampling switches 151 to be described below (see FIG. 2).

The D/A converter group 304 comprises D/A converters provided for every channel, which convert video data Vd1*d* to Vd6*d* into analog image signals, each having a voltage corresponding to a gray scale of each pixel.

The amplification/inversion circuit 306 inverts the image signals, which need to be inverted, among the analog-converted image signals, amplifies them as required, and supplies them as image signals Vd1 to Vd6. Here, as polarity inversion, (1) polarity inversion for every scanning line, (2) polarity inversion for every data signal line, (3) polarity inversion for every a pixel, and (4) polarity inversion for every screen (frame) may be exemplified. In this embodiment, for the convenience of description, it is assumed that (1) the polarity inversion for every scanning line is implemented. However, this embodiment is intended to limit the present invention. Further, the polarity inversion in the present embodiment signifies to alternately invert a voltage level with a predetermined constant voltage Vc as a reference (which is a center potential of the amplitude of the image signal and is approximately equal to a voltage LCcom to be applied to a counter electrode. And then, a higher level voltage than the voltage Vc signifies positive and a lower level voltage than the voltage Vc signifies negative.

Moreover, although video data Vd1*d* to Vd6*d* converted by the S/P conversion circuit 302 are converted into the analog image signals, the conversion to analog may be performed after the amplification/inversion.

Next, the precharge voltage generating circuit 400 which is an essential portion will be described.

In the precharge voltage generating circuit 400, a subtracter 402 subtracts reference data Ref from video data Vid and outputs the subtraction result as data Def. Here, reference data Ref is data having a value, for example, which corresponds to the gray color of an intermediate value between a lowest gray scale and a highest gray scale of the pixel. Reference data Ref is used to calculate a change in gray scale which is displayed with video data Vid.

Upon receiving a signal HR which becomes H level only in a horizontal effective display period, an integrator 404 resets an integration result in synchronization with a rising edge of the signal HR, integrates (cumulates) data Def during a period in which the signal is H level, and outputs data Int indicating the integrated value. A latch circuit 406 latches data Int when image data Vid corresponding to the pixels in the last row is output and outputs latch data L1. The multiplier 408 multiplies latch data L1 by a coefficient k1 to generate correction data Er.

An adder 410 adds correction data Er to voltage data Pre which defines a reference value of a precharge voltage. A latch circuit 412 latches the result added by the adder 410 and holds as corrected data Pre-a. A D/A converter 414 converts the corrected data Pre-a into an analog voltage signal. An inversion circuit 416 inverts the level of the voltage signal converted by the D/A converter 414 on the basis of the voltage Vc to have the same polarity as those of the image signals Vd1 to Vd6 and outputs precharge signal Vpre.

The selector 350 selects the image signals Vd1 to Vd6 by the amplification/inversion circuit 306 when a signal NRG is L level and selects the precharge signal Vpre by the precharge voltage generating circuit 400 when the signal NRG is H level. And then, the selector 350 supplies the display panel 100 with signals Vid1 to Vid6. Here, the signal NRG is the signal which is supplied from the control circuit 200, and when the signal NRG is H level, precharging to the data lines is instructed. Moreover, in this embodiment, it is assumed that the pulse width of the signal NRG is constant for every horizontal scanning period.

Figure 2:
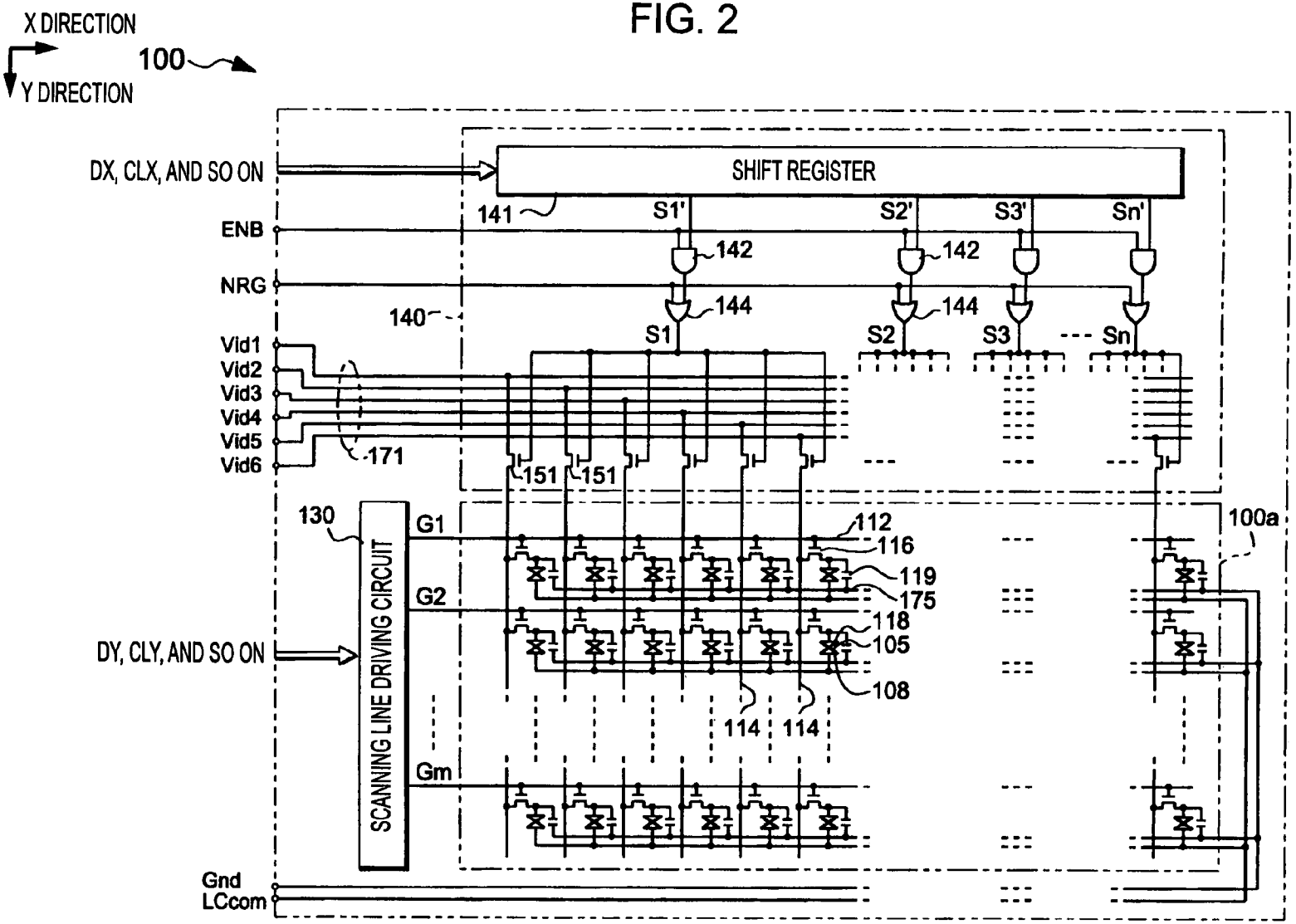
FIG. 2 is a block diagram showing an electrical configuration of a display panel in the liquid crystal display device shown in FIG. 1.

Next, a configuration of the display panel 100 will be described in detail. FIG. 2 is a block diagram showing an electrical configuration of the display panel 100.

As shown in FIG. 2, in a display region 100*a*, a plurality of scanning lines 112 are formed to extend in an X direction, while a plurality of data lines 114 are formed to extend in a Y direction. And then, in each of intersections of the scanning lines 112 and the data lines 114, a pair of a thin film transistor (hereinafter, referred to as 'TFT') 116 and a pixel electrode 118 are provided. Here, a gate, a source, and a drain of the TFT 116 are connected to the scanning line 112, the data line 114, and the pixel electrode 118, respectively.

Further, a counter electrode 108 which is maintained at a constant voltage LCcom is provided so as to oppose the pixel electrodes 118, and a liquid crystal layer 105 is interposed between the pixel electrodes 118 and the counter electrode 108.

For the convenience of description, when the total number of the scanning lines 112 is 'm' and the total number of the data lines 114 is '6n' (where m and n are integers), the pixels are arranged in a matrix shape of m rows×n columns in association with the respective intersections of the scanning lines 112 and the data lines 114.

Further, to suppress the leakage of electric charges in liquid crystal capacitors, storage capacitors 119 are formed for the pixels respectively. One ends of the storage capacitors 119 are connected the pixel electrodes 118 (the drains of the TFTs 116) respectively and the other ends thereof are commonly grounded by a capacitor line 175.

Figure 3:
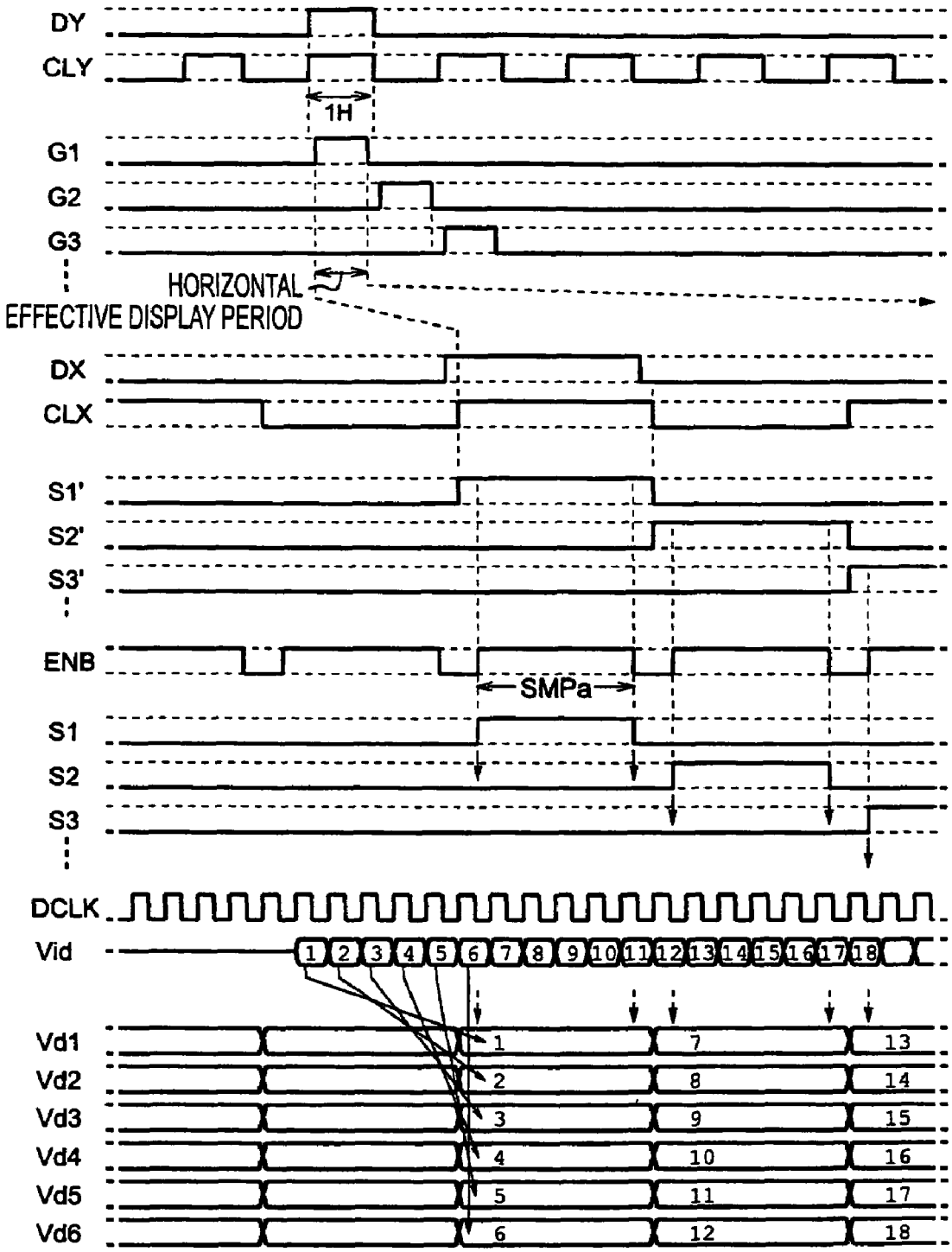
FIG. 3 is a timing chart illustrating operations of the liquid crystal display device shown in FIG. 1.

Meanwhile, a scanning line driving circuit 130 and a data line driving circuit 140 is provided around the display region 100*a*. Among them, as shown in FIG. 3, the scanning line driving circuit 130 outputs scanning signals G1, G2, . . . , Gm which become active (H) level sequentially for one horizontal effective display period. Moreover, the scanning line driving circuit 130 have not immediate relation with the present invention, and the detailed description thereon will be omitted. However, the scanning line driving circuit 130 shifts sequentially a transmission start pulse DY which is supplied at the beginning of one vertical scanning period whenever the level of a clock signal CLY transits, and then shapes waveforms of them to generate the scanning signals G1, G2, . . . , Gm.

Further, the data line driving circuit 140 has a shift register 141, AND circuits 141, OR circuits 144, and the sampling switches 151. Among them, as shown in FIG. 3, the shift register 141 shifts sequentially a transmission start pulse DX which is supplied at the beginning of one horizontal effective display period whenever the level of a clock signal CLX transits (rises or lowers), and then outputs signals S1', S2', S3', . . . , Sn' in association with blocks of the data lines.

The AND circuits 142 are respectively provided in respective output terminals of the shift register 141 and output logical AND signals of the signals from the output terminals and a signal ENB which is supplied from the control circuit 200. Accordingly, the signals from the respective output terminals of the shift register 141 are narrowed to the pulse width SMPa of the signal ENB respectively, such that adjacent signals are prevented from overlapping each other due to the signal delay.

The OR circuits 144 output logical OR signals of the logical AND signals by the AND circuits 142 and the signal NRG which is supplied from the control circuit 200 as sampling signals. As such, the signals S1', S2', S3', . . . , Sn' from the shift register 141 pass the AND circuits 142 and the OR circuits 144 sequentially, such that finally the sampling signals S1, S2, S3, . . . , Sn are output.

The sampling switches 151 sample the signals Vid1 to Vid6 for six channels which are supplied through six image signal lines 171 to the respective data lines 114 corresponding to the sampling signals S1, S2, S3, . . . , Sn. Here, the sampling switch 151 is provided for every data line 114.

In the present embodiment, the data lines 114 are divided into blocks with six data lines, and the sampling switch 151, which is connected to one end of the leftmost data line 114 among the six data lines 114 belonging to an i-th (where i is 1, 2, . . . , n) block from a left side of FIG. 2, samples the signal Vid1 supplied through the image signal line 171 in a period where the sampling signal Si becomes active, and supplies the sampled signal to the corresponding data line 114. Further, the sampling switch 151, which is connected to one end of the second data line 114 in the same block, samples the signal Vid2 in a period where the sampling signal Si becomes active, and supplies the sampled signal to the corresponding data line 114. Similarly, the sampling switches 151, which are respectively connected to one end of the third, fourth, fifth and sixth data lines 114 among the six data lines 114 belonging to the same block, sample the signals Vid3, Vid4, Vid5 and Vid6 in a period where the sampling signal Si becomes active level, and supply the sampled signals to the corresponding data lines 114, respectively.

Therefore, the signals Vid1 to Vid6 supplied to the image signal lines 171 are sampled by the shift register 141, the AND circuits 142, and the sampling switches 151 to the data lines 114. As described below, however, when the signal NRG is H level, a portion of the data line driving circuit 140 serves as a precharge circuit for precharging the data lines 114 with the voltage of the precharge signal Vpre, as described below.

Moreover, elements constituting the scanning line driving circuit 130 or the data line driving circuit 140 are formed with the common process to the TFTs 116 which drive the pixels, such that the entire device can be miniaturized or a manufacturing cost can be reduced.

Next, operations of the electro-optical device will be described. To begin with, at the beginning of the vertical scanning period, the transmission start pulse DY is supplied to the scanning line driving circuit 130. If the transmission start pulse DY is supplied, as shown in FIG. 3, the scanning signals G1, G2, G3, . . . , Gm become active level sequentially and exclusively to be respectively output to the scanning lines 112.

Figure 4:
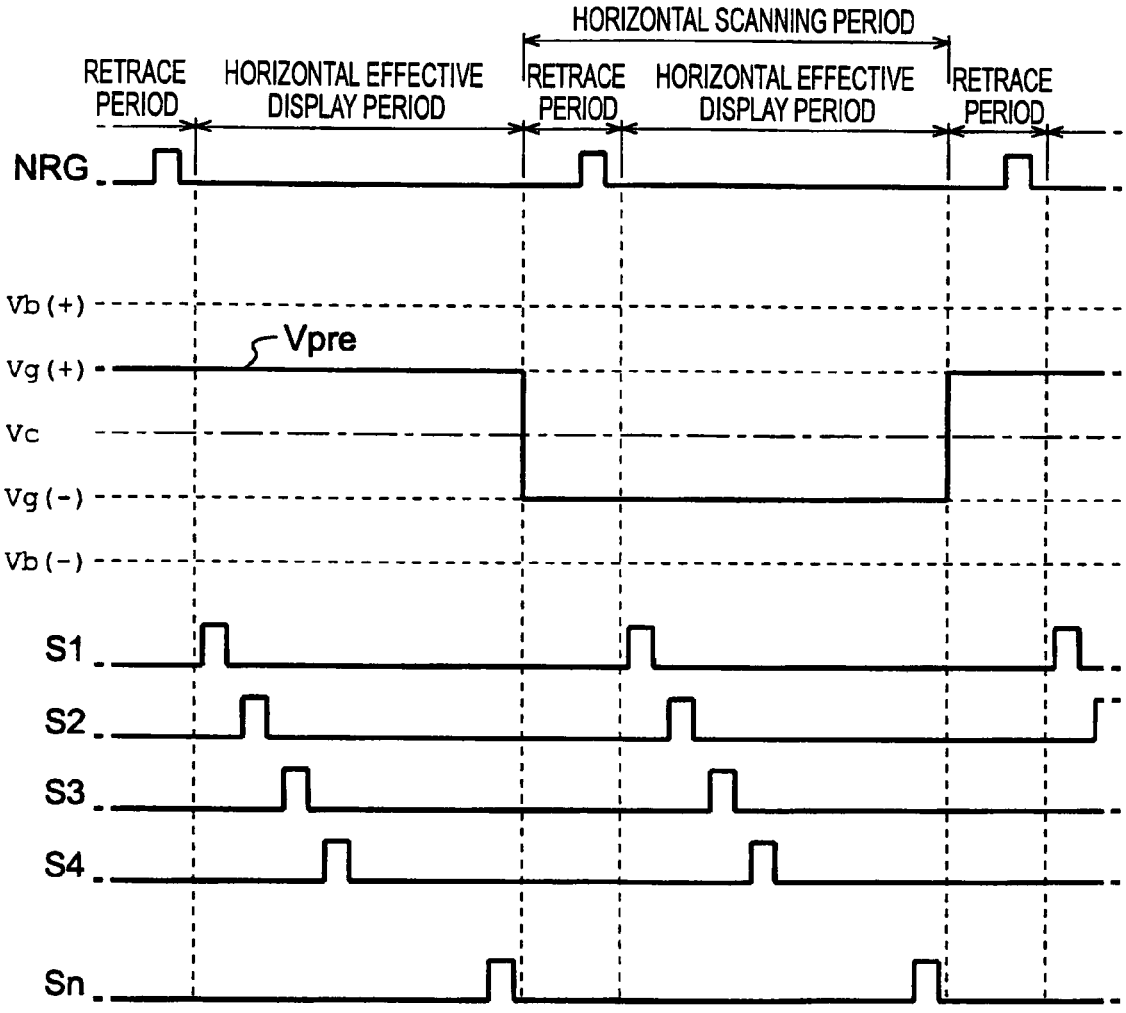
FIG. 4 is a timing chart illustrating operations of the liquid crystal display device shown in FIG. 1.

First, paying attention to the horizontal effective display period where the scanning signal G1 becomes active level, the signal NRG becomes H level in a retrace period prior to the horizontal effective display period or a precharge period overlapping the retrace period but front and rear ends thereof, as shown in FIG. 3 or 4.

Here, for the convenience of description, since there is needed an explanation of causing display unevenness in the display panel 100, it is assumed that the precharge voltage generating circuit 400 does not correct the precharge signal Vpre. That is, as shown in FIG. 4, the precharge voltage Vpre is assumed to be inverted with a precharge voltage having a reference value which is defined by voltage data Pre. Specifically, the precharge voltage Vpre is assumed to be inverted with a voltage Vg(+) corresponding to the gray color of positive writing just before the positive writing and a voltage Vg(−) corresponding to the gray color of negative writing just before the negative writing for every one horizontal scanning period.

If the signal NRG is H level, the selector 350 selects the precharge signal Vpre. Thus, on an assumption that writing polarity just thereafter is positive, the voltage Vg(+) is applied to each of the six image signal lines 171. Further, if the signal NRG becomes H level, the logical OR signal of the OR circuit 144 becomes H level irregardless of the level of the logical AND signal by the AND circuit 142, such that all the sampling switches 151 are turned on. Therefore, if the signal NRG becomes H level, all the data lines 114 are precharged with the voltage Vg(+) corresponding to the positive writing.

Therefore, when the signal NRG is H level, the precharge circuit is constructed by the precharge voltage generating circuit 400, the selector 350, the image signal lines 171, and the OR circuits 144, and the sampling switches 151, such that the data lines 114 are precharged with the voltage of the precharge signal Vpre.

Next, if the retrace period is complete, the transmission start pulse DX is sequentially shifted by the shift register 141, and thus the signals S1', S2', S3', . . . , Sn' are output during the horizontal effective display period, as shown in FIG. 3 or 4. In addition, the logical AND signals of the signals S1', S2', S3', . . . , Sn' and the signal ENB are generated by the AND circuits 142. Here, the sampling signals S1, S2, S3, . . . , Sn are narrowed to the period SMPa such that pulse widths of adjacent sampling signals do not overlap each other. And thus sampling signals S1, S2, S3, . . . , Sn are sequentially output.

Meanwhile, first, the S/P conversion circuit 302 divides the video data Vid, which is supplied in synchronization with horizontal scanning, into the six channels and extends them six-fold along the time axis. Next, the D/A converter group 304 converts them into the analog signals and outputs the non-inverted analog signals on the voltage Vc basis corresponding to the positive writing. For this reason, the non-inverted image signals Vd1 to Vd6 have the higher level voltages than the voltage Vc as the pixels are made to black.

Further, in the horizontal effective scanning period, the signal NRG becomes L level. For this reason, the selector 350 selects the image signals Vd1 to Vd6, and thus the image signals Vd1 to Vd6 by the processing circuit 300 are output as the signals Vid1 to Vid6 which are supplied to the six image signals lines 171.

In the horizontal effective scanning period where the scanning signal G1 becomes an active level, for the six data lines 114 belonging to the first block from the left side, a corresponding signal of the image signals Vd1 to Vd6 is sampled. And then, the sampled image signals Vd1 to Vd6 are respectively applied to the pixel electrodes 118 of the pixels which are respectively disposed at the intersections of the first scanning line 112 from the upper side of FIG. 2 and the six data lines 114.

Subsequently, if the sampling signal S2 becomes active level, now, for the six data lines 114 belonging to the second block, the image signals Vd1 to Vd6 are respectively sampled. And then, the image signals Vd1 to Vd6 are respectively applied to the pixel electrodes 118 of the pixels which are respectively disposed at the intersections of the first scanning line 112 and the six data lines 114.

Similarly, if the sampling signals S3, S4, . . . , Sn become active level sequentially, for the six data lines 114 belonging to each of the third, fourth, . . . , and n-th blocks, the image signals Vd1 to Vd6 are respectively sampled, and the image signals Vd1 to Vd6 are applied to the pixel electrodes 118 of the pixels which are respectively disposed at the intersections of the first scanning line 112 and the six data lines 114. As a result, the writings for all the pixels in the first row are completed.

Subsequently, a period where the scanning signal G2 becomes active will be described. In the present embodiment, as described above, the polarity inversion is performed on the scanning line basis, and thus, in this horizontal scanning period, the negative writing is performed.

First, paying attention to the horizontal effective display period where the scanning signal G2 becomes active level, the signal NRG becomes H level in the precharge period of the retrace period prior to the horizontal effective display period. In this situation, when the precharge signal Vpre is not corrected, as shown in FIG. 4, the precharge voltage generating circuit 400 makes the precharge signal Vpre for each channel the voltage Vg(−) which corresponds to the gray color of the negative writing just before the negative writing. Therefore, the voltage Vg(−) is precharged corresponding to the negative writing, for all of the data lines 114.

Other operations are the same as those when the scanning signal G1 becomes active. The sampling signals S1, S2, S3, . . . , Sn become active level sequentially, and then the writings for the pixels of the second row are completed. However, the amplification/inversion circuit 306 inverts and outputs the analog signals by the D/A conversion circuit 304 corresponding to the negative writings on the voltage Vc basis. Thus, the image signals Vd1 to Vd6 have the lower level voltages than the voltage Vc as the pixels are made to black.

Hereinafter, similarly, the scanning signals G3, G4, . . . , Gm become active, the writings for the pixels of the third, fourth, . . . , m-th rows are performed. Thus, the positive writings are performed for the pixels of odd-numbered rows, while the negative writings are performed for the pixels of even-numbered rows. And then, in one vertical scanning period, the writings of all the pixels of the first to m-th rows are completed.

And then, in next one vertical scanning period, the same writings are also performed. However, in this case, the writing polarities for the pixels of the respective rows are inverted. That is, in next one vertical scanning period, the negative writings are performed for the odd-numbered rows, while the positive writings are performed for the even-numbered rows. As such, since the writing polarity for the pixels is inverted for every vertical scanning period, there is no case in which direct current components are not applied to the liquid crystal layer 105, such that the liquid crystal layer 105 is prevented from deteriorating.

Figure 13:
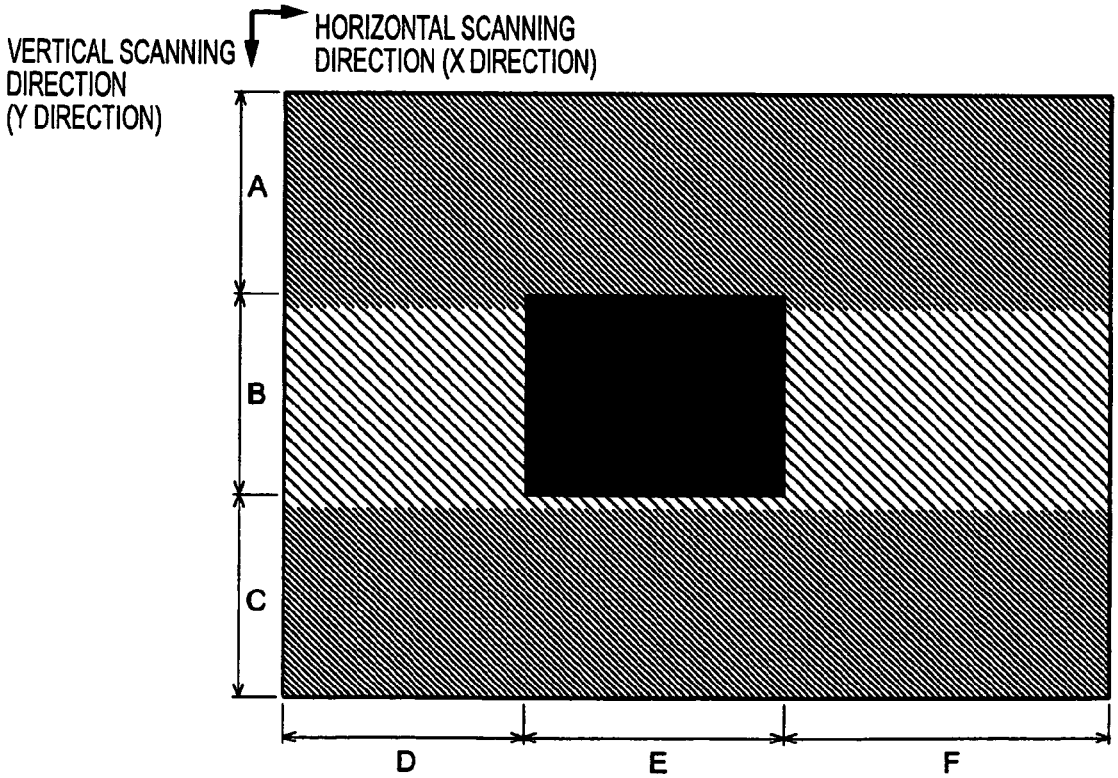
FIG. 13 is a diagram showing deterioration of the display quality caused by horizontal crosstalk.

However, in such writing, when a black region is displayed in the window over a gray background in the display panel 100, display unevenness is caused by horizontal crosstalk as shown in FIG. 13. The reason is as described above. Here, from a viewpoint that the bright gray region is shifted with respect to the black region by one row, it can be expected up to a certain degree that only the writing of the bright gray region is influenced by the writing of the row including the black region, that is, the row just therebefore. For this reason, the present inventors consider the degree of a brightness difference from various display patterns and specify that the horizontal crosstalk to be solved by the present invention is caused by the writing deficiency of the precharge voltage which is executed in the retrace period.

Figure 5:
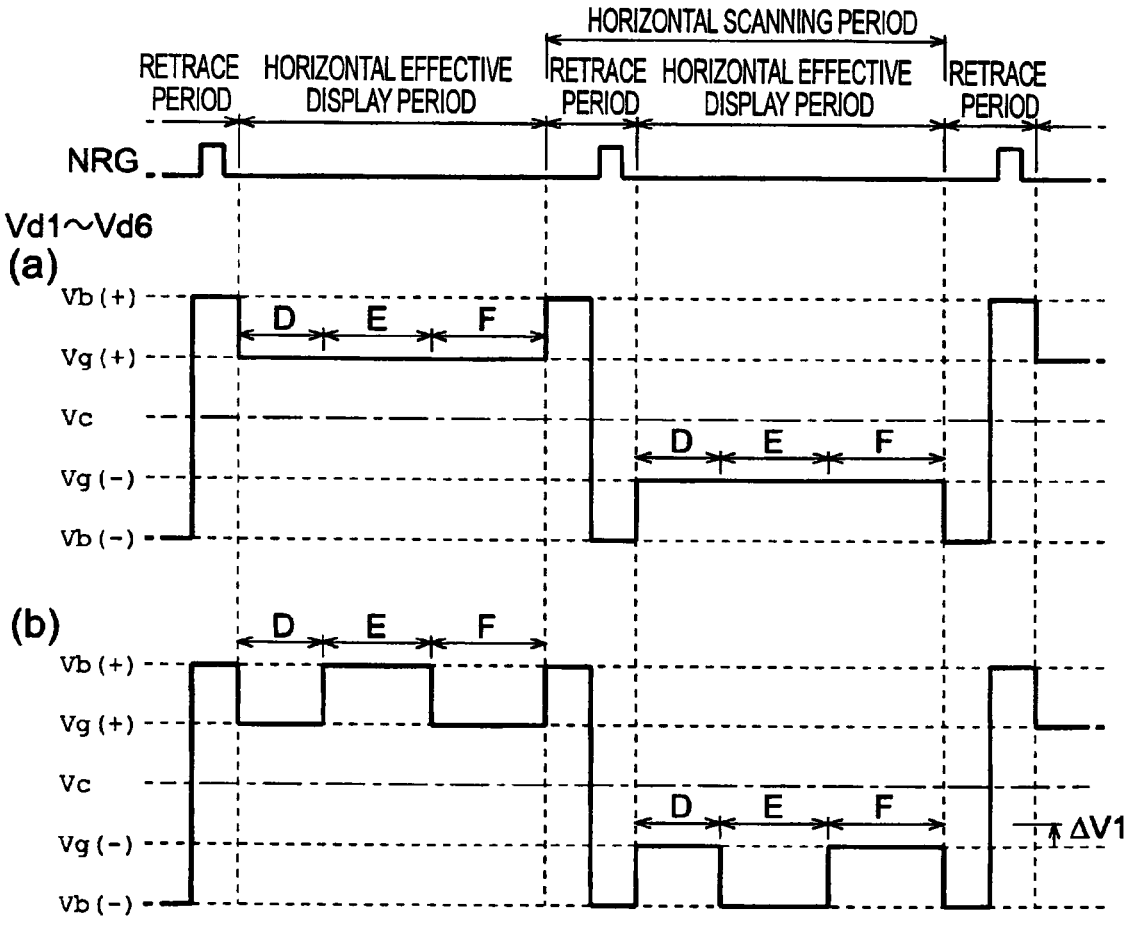
FIG. 5 is a timing chart illustrating operations of the liquid crystal display device shown in FIG. 1.

Next, the writing deficiency of the precharge voltage will be described. In FIG. 13, when the scanning lines 112 belonging to an A region or a C region are selected (only the gray region except for the black region is horizontally scanned), the signal Vdi (one of Vd1 to Vd6) which is supplied to any one of the image signal lines 171 becomes the voltage Vg(+) or the voltage Vg(−) corresponding to the gray color corresponding to the writing polarity during the one horizontal effective display period, as shown in FIG. 5A, and is alternately inverted for every one horizontal scanning period. This means that, in one horizontal effective display period where the positive writing is performed, for example, the voltage Vg(+) is sampled for all the data lines 114 when the corresponding sampling switches 151 are turned on. Further, since the parasitic capacitance exist on the data line 114 up to a certain degree, even when the corresponding sampling switch 151 is turned off, the voltage Vg(+) of the image signal sampled when the sampling switch 151 is turned on is maintained.

After the positive writing, the negative writing is performed, but precharging is performed just therebefore, as described above. For this reason, just before the negative writing, all the data lines 114 are precharged with the voltage Vg(−) corresponding to the negative writing from the voltage Vg(+).

Meanwhile, in FIG. 13, when the scanning line 112 belonging to a B region is selected (a region including the black region is horizontally scanned), in the case of the positive writing, as shown in FIG. 5B, the image signal Vdi which is supplied to any one of the image signal lines 171 becomes the Voltage Vg(+) corresponding to the gray color at the time of the horizontal scanning on the data lines 114 which belong to a D region or an F region and becomes Vb(+) corresponding to the black color at the time of the horizontal scanning on the data lines 114 which belong to an E region. This means that, for example, in one horizontal effective display period where the positive writing is performed, the voltage Vg(+) is sampled for the data lines 114 which belong to the D region and the F region, while the voltage Vb(+) is sampled for the data lines 114 which belong to the E region, which are respectively maintained even when the sampling switches 151 are turned off. That is, just before precharging, the data lines 114 belonging to the D region and the F region are maintained at the voltage Vg(+), while the data lines 114 belonging to the E region are maintained at the voltage Vb(+) which is higher than the voltage Vg(+).

For this reason, it may be understood that, just after the scanning line 112 belonging to the B region is selected, charging and discharging quantities required for precharging all the data lines 114 with the voltage Vg(−) are large as compared to the case just after the scanning line 112 belonging to the A region or the C region is selected, and thus a long period is required.

In a recent display panel, the number of pixels increases and high speed driving is demanded accordingly, which results in a problem in that the time required for precharging can not be ensured. Therefore, in the case of precharging just after the positive writing and just before the negative writing, the voltage to be actually precharged in the data line 114 when the scanning line 112 belonging to the B region is selected becomes higher by ΔV1 than the voltage Vg(−) as a target, as compared to that when the scanning line 112 belonging to the A region or the C region is selected, as shown in FIG. 5B.

That is, there may be cases in which the data line 114 is precharged with the voltage Vg(−) and in which the data line 114 is precharged with the voltage higher by the voltage ΔV1 than the voltage Vg(−). In both cases, at the time of the negative writing, the same voltage Vg(−) corresponding to the gray color is sampled for the data line 114. However, a voltage which is finally written into the pixel electrodes 118 in the latter case becomes higher than that in the former case. For this reason, the effective voltage of the liquid crystal capacitor in the latter case becomes smaller than that in the former case. That is, the effective voltage of the liquid crystal capacitor which is written in a horizontal scanning period next to the horizontal scanning period where the scanning line 112 belonging to the B region is selected becomes smaller than the effective voltage of the liquid crystal capacitor which is written in a horizontal scanning period next to the horizontal scanning period where the scanning line 112 belonging to the A region or the C region is selected, for example, though the same gray color. Therefore, in the normally white mode, the display becomes brighter as the effective voltage becomes smaller. This is visible as the brightness difference.

Moreover, just after the negative writing and just before the positive writing, voltage swing directions are opposite to each other, but the effective voltage also becomes smaller. Further, in the black region other than the gray region, similarly, the effective voltage may become smaller, but the brightness difference in the black region is not visible clearly. This is because, in the liquid crystal device, a characteristic of transmittance to the effective voltage (V-T characteristic) around white or black is blunt than that around gray, such that the brightness difference is not almost visible even when the effective voltage is somewhat different.

Here, if horizontal crosstalk is caused by the wiring deficiency of precharging, it may be considered as a solution not to perform such precharging. However, in a recent display panel, since the number of pixels is very large, the writing time to the pixel electrode is not ensured sufficiently. For this reason, if the data lines 114 are not precharged, the image signals can not be sampled for the data lines 114 in a short time. Further, in the state in which the voltages remaining on the data lines are different from each other, if the image signals are written into the pixel electrodes via the data lines, display degradation much worse than horizontal crosstalk is caused. Therefore, the solution that precharging is not performed can not be adopted without much thought.

As such, the effective voltage which is written into the liquid crystal capacitor through the horizontal scanning in one horizontal scanning period swings depending to the voltages precharged in the data lines 114 just therebefore. Here, the voltages precharged in all the data lines 114 depends on the contents of gray scales for the pixels of one row horizontally scanned just therebefore. This means that, on the contrary, the contents for the pixels of one row which are horizontally scanned in one horizontal scanning period similarly influence the voltages which are precharged in the data lines just before the writing of next one horizontal scanning period.

And then, it is to be understood that, by correcting the voltage of the precharge signal just before the pixels for one row are horizontally scanned in one horizontal period so as to expect the deficiency which is determined by the contents of the pixels for one row just therebefore, and by accurately approximating the voltage which is actually precharged in the data line 114 by a target, the writing deficiency can be prevented.

To this end, a configuration from the subtracter 402 to the adder 410 in the precharge voltage generating circuit 400 is provided. According to this configuration, for the pixels of one row, the difference between the gray scale of each pixel and the reference gray scale is integrated (cumulated), the value corresponding to the integrated value (cumulative value) as the correction value is added to voltage data Pre which defines the reference value of the precharge voltage, and the precharge signal is generated corresponding to the added result.

Figure 6:
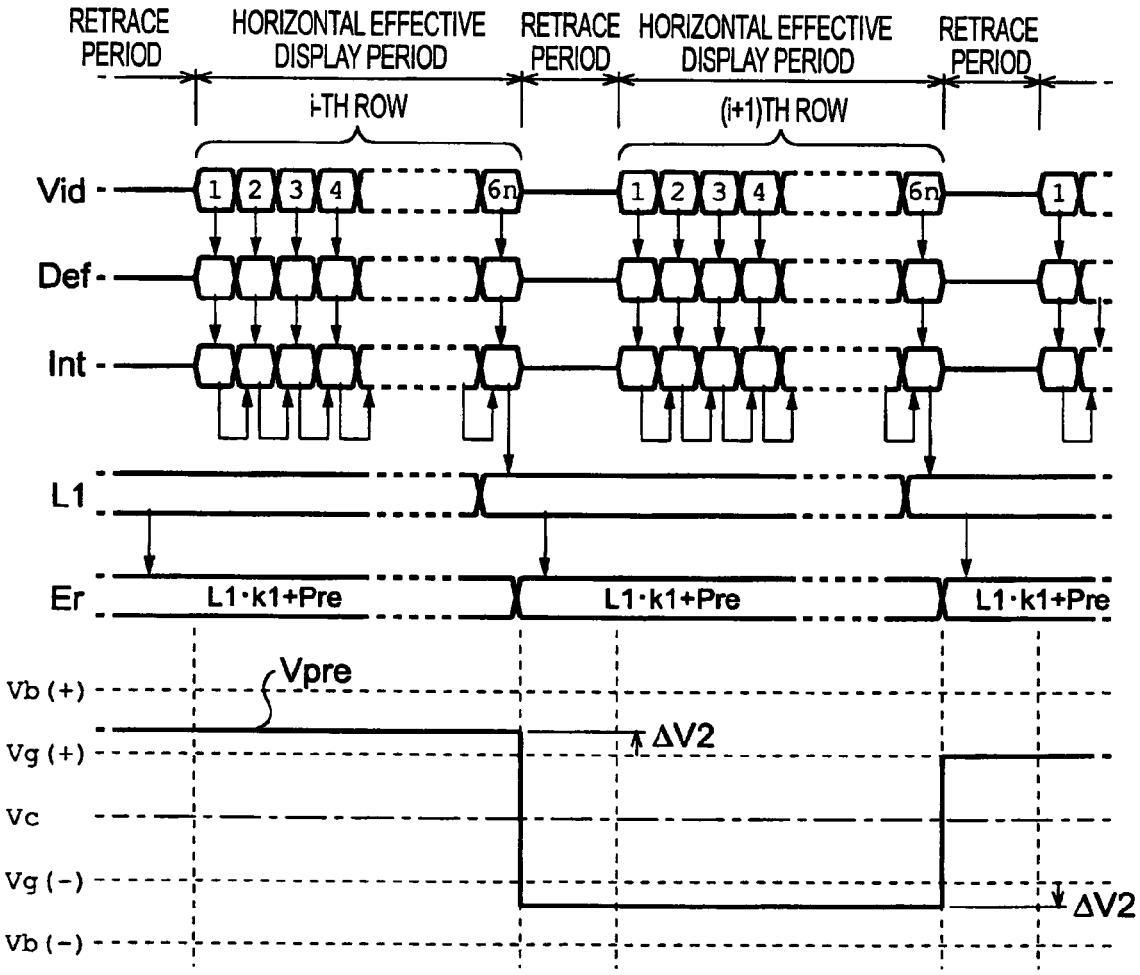
FIG. 6 is a timing chart illustrating operations of a precharge voltage generating circuit of the liquid crystal display device shown in FIG. 1.

Since the configuration of the precharge voltage generating circuit 400 is already described, hereinafter, an operation thereof will be described with reference to a timing chart of FIG. 6.

First, in one horizontal effective display period, video data Vid is supplied to each pixel according to the horizontal scanning.

And then, subtraction data Def which is the difference between the gray scale to be represented by video data Vid and the reference gray scale to be represented by reference data Ref is obtained by the subtracter 402 for every pixel. In addition, subtraction data Def is integrated by the integrator 404, such that integration data Int is output. Therefore, if integration data Int is latched at the timing that video data Vid of the pixels of the last row is output, latch data L1 corresponding to the latched result represents the value which is obtained by integrating (cumulating) subtraction data Def for the pixels of one row at the time of the corresponding horizontal scanning.

The value to be represented by Latch data L1 is multiplied with the coefficient k1 by the multiplier 408, and the multiplication result becomes correction data Er. In addition, correction data Er is added to voltage data Pre by the adder 410, and then the added result is maintained in the latch circuit 412 as corrected data Pre-a.

Corrected data Pre-a is converted into the analog voltage signals by the D/A converter 414, and then the analog voltage signals are inverted by the inversion circuit 416 on the voltage Vc basis to have the same polarity as that of the wiring polarity in a horizontal effective display period next to the corresponding horizontal effective display period.

For this reason, as regards the pixels of one row, if the image signals Vd1 to Vd6 for the one row are supplied, in a retrace period thereafter and next writing polarity is positive, the voltage of the precharge signal Vpre becomes a value which is obtained by adding a voltage ΔV2 corresponding to correction data Er in the one row to the voltage Vg(+). In the meantime, if the next writing polarity is negative, the voltage of the precharge signal Vpre becomes a value which is obtained by subtracting the voltage ΔV2 corresponding to correction data Er from the voltage Vg(−).

Therefore, for example, in FIG. 13, when the scanning line 112 belonging to the A region or the C region is selected, all the horizontally scanned pixels have the gray colors, such that the value to be represented by integration data Int in which the difference with the reference gray scale to be represented by reference data Ref is cumulated for one row is near zero. For this reason, the precharge voltage Vpre after the selection is not almost corrected and becomes approximately Vg(+) or Vg(−) as the reference value. To the contrary, when the scanning line 112 belonging to the B region, the horizontally scanned pixels have colors in each of which the black color of the E region is added to the gray color of the D region or the F region, such that the value to be represented by integration data Int becomes larger. For this reason, when the writing polarity just after precharging is positive, the precharge voltage Vpre thereafter becomes the value which is obtained by adding the voltage ΔV2 to the voltage Vg(+). Meanwhile, when the writing polarity just after precharging is negative, the precharge voltage Vpre thereafter becomes the value which is obtained by subtracting the voltage ΔV2 from the voltage Vg(−).

Therefore, in a state in which the precharge voltage Vpre is precharged in a direction which makes the bright portion darker, the writing is performed, such that the bright portion is guided darker. As a result, the above-mentioned horizontal crosstalk can be solved.

Further, herein, as shown in FIG. 13, the example in which the rectangular black region is displayed in the window over the gray background is described, but when a white region is displayed in the window over the gray background, the pixels are changed in a direction that the effective voltage becomes large, that is, in a direction which makes pixels dark in the normally white mode. However, in the present embodiment, as compared to the case in which the black region is displayed in the window, negative and positive signs of data Def are inverted, and thus the correction direction of the precharge voltage Vpre is reversed. That is, in a state in which the precharge voltage is precharged in a direction which makes the darker portion bright, the writing is performed, such that the dark portion is guided brighter.

Further, in the above-mentioned embodiment, subtraction data Def is integrated for all the pixels of one row. However, only for a portion of the pixels of one row, for example, for the pixels of odd-numbered columns, subtraction date Def is integrated. This is because the integrated value for the portion of the pixels of one row reflects the integrated value for all the pixels of one row up to a certain degree. Specifically, in a natural image or a photographic image, gray scales in adjacent pixels have high corelationship with each other, and thus there is no need obtaining the integrated value for all the pixels of one row.

Figure 8:
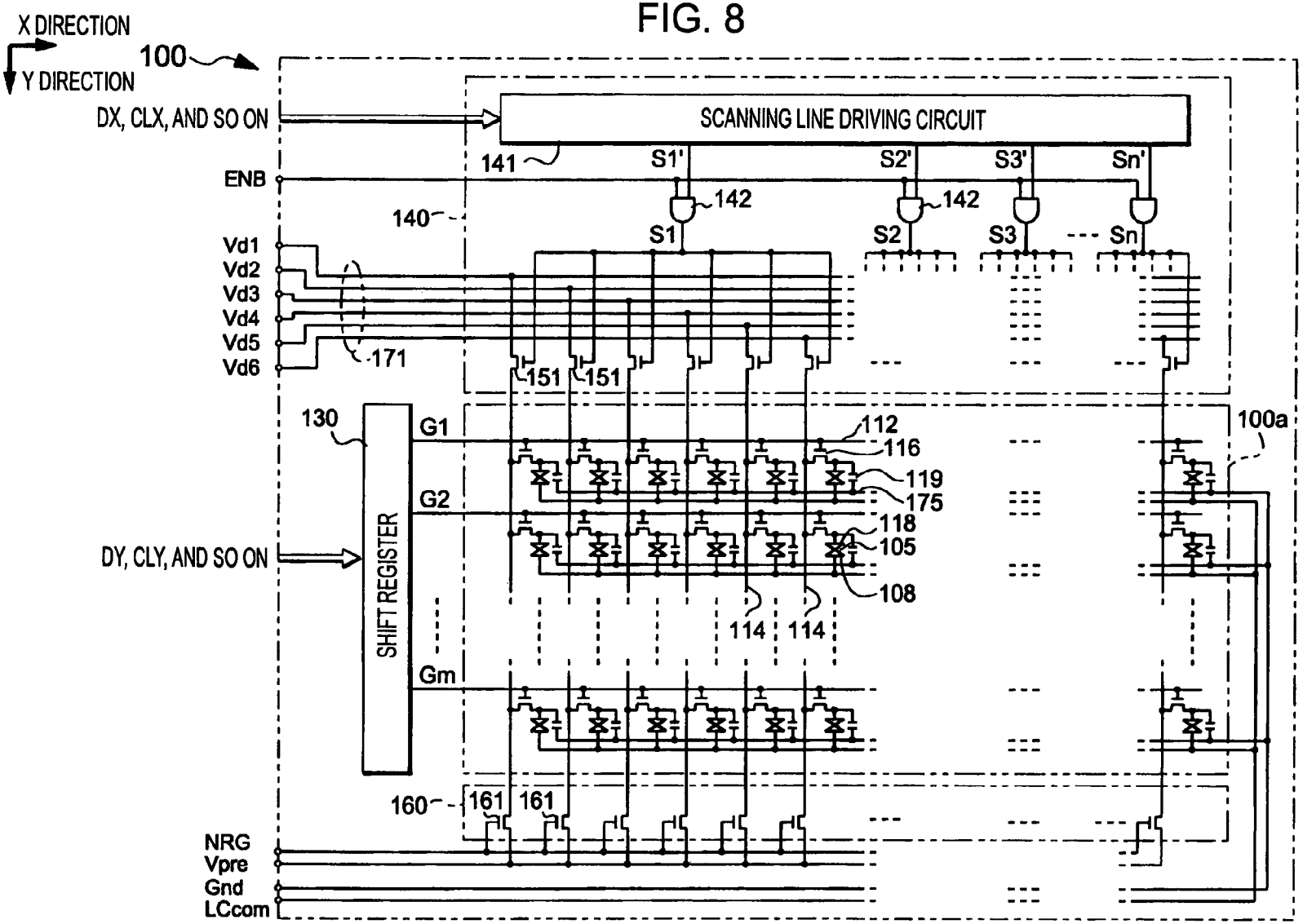
FIG. 8 is a block diagram showing an electrical configuration of a display panel of the liquid crystal display device shown in FIG. 7.

Further, in the above-mentioned embodiment, the precharge signal Vpre is supplied through the image signal lines 171 in a horizontal retrace period and is sampled and precharged for all the data lines 114 corresponding to the signal NRG. However, as shown in FIG. 8, switches 161 which are turned on by the signal NRG may be provided respectively at one ends of the data lines 114, and thus the precharge voltage may be precharged in the data lines 114 without passing through the image signal lines 171.

Figure 7:
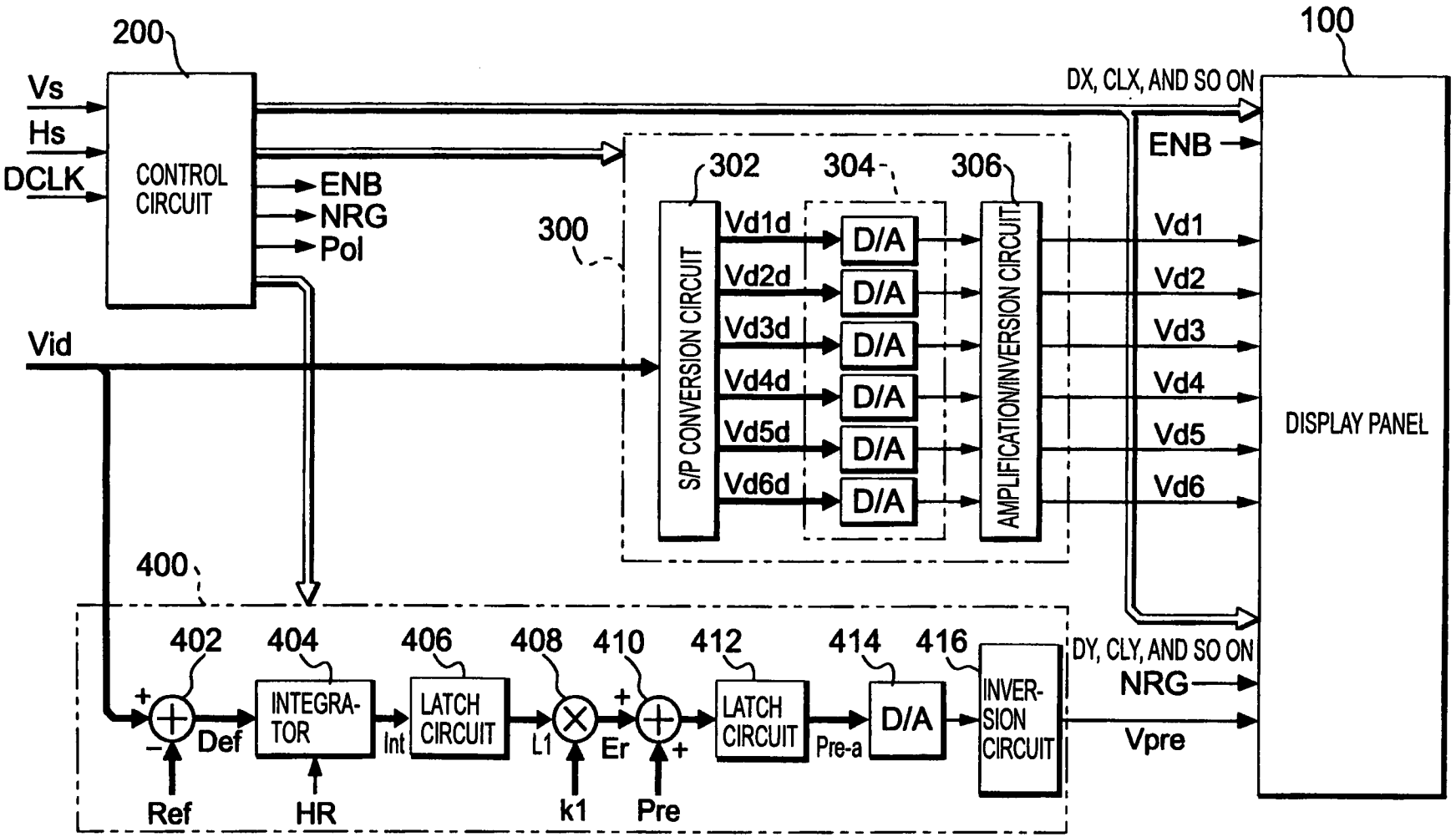
FIG. 7 is a block diagram showing an entire configuration of a liquid crystal display device according to a modification of the present invention.

Moreover, in this configuration, as shown in FIG. 7, the selector 350 is not needed, and the image signals Vd1 to Vd6 by the amplification/inversion circuit 306 are supplied to the image signal lines 171 as they are. Further, the precharge signal Vpre by the inversion circuit 416 is applied to the data lines 114 via the turned-on switches 161.

Further, in the above-mentioned embodiment, the processing circuit 300 or the precharge voltage generating circuit 400 processes the signals in a digital manner, but it may be made to process the signals in an analog manner with the voltage which represents the gray scale of the pixel.

In addition, in the above-mentioned embodiment, the normally white mode in which the white display is performed when the effective voltage between the counter electrode 108 and the pixel electrode 118 is small is described. However, a normally black mode which performs black display may be adopted. Further, as the reference voltage of the precharge signal, the voltages Vg(+) and Vg(−) which correspond to the gray color and which are inverted for one horizontal scanning period corresponding to the writing polarity are used. However, a voltage corresponding to a white color or a black color may be used. For example, in the positive writing, the voltage Vc corresponding to the white color may be used, and in the negative writing, the voltage Vb(+) corresponding to the black color may be used. That is, the voltage corresponding to different gray scale corresponding to the writing polarity may be used. Moreover, when the reference voltage of the precharge signal is different corresponding to the writing polarity, voltage data Pre is needed to be switched corresponding to the writing polarity.

In addition, in the embodiment, the precharge signal Vpre is inverted by the inversion circuit 416 on the voltage Vc basis to corresponding to the positive writing or the negative writing. However, an output range of the D/A converter 414 may be expanded such that it covers from the voltage Vg(−) corresponding to a negative black color to the voltage Vg(+) corresponding to a positive black color, and thus both polarities may be divided and processed with digital values.

In addition, in the embodiment, the pulse width of the signal NRG which defines precharging is constant and the voltage of the precharge signal as the reference is corrected by correction data Er. However, the voltage of the precharge signal may be constant and the pulse width of the signal NRG may be corrected by correction data Er. In this case, for example, as an occupying ratio of the black region to the gray region becomes large, the pulse width of the signal NRG is corrected to be widened.

That is, in the present invention, the voltage to be finally precharged in the data lines 114 may reflect correction data Er on the basis of the integrated value.

Further, in the embodiment, the vertical scanning direction is from G1 to Gm, and the horizontal scanning direction is form S1 to Sn. However, when the present invention is applied to a rotatable display panel or a projector described below, the scanning direction is needed to be inverted. In this case, since video data Vid is supplied in synchronization with the vertical scanning and the horizontal scanning, there is no need for changing the processing circuit 300 or the precharge voltage generating circuit 400.

In the above-mentioned embodiment, the six data lines 114 is grouped into one block, and for the six data lines 114 belonging to one block, the image signal Vd1 to Vd6 which are converted into the six channels are sampled. However, the number of the converted channels or the number of the data lines to which the image signals are supplied simultaneously (that is, the number of the data lines constituting one block) are not limited to 'six'. For example, if a response speed of the sampling switch 151 is sufficiently high, the corrected image signals are transmitted to one image signal line in serial without being converted in parallel, and then they are sequentially sampled for the data lines 114. Further, the number of the converted channels and the number of the data lines to which the image signals are simultaneously supplied may be '3', '12', '24', or '48'. Specifically, for three, twelve, twenty four, or forty eight data lines, corrected image signals converted into three, twelve, twenty four, or forty eight channels may be simultaneously supplied. Moreover, as the number of the converted channels, since a color image signal is made of three primary colors, multiples of three are preferable in terms of easy control or simple circuit. Meanwhile, for simple optical modulation in the projector described below, the multiples of three are not needed.

In addition, in the embodiment, a glass substrate is used as an element substrate. However, with an SOI (silicon on insulator) technology, silicon single crystal film may be formed on an insulating substrate such as sapphire, quartz, or glass, and various elements may be provided thereon. Further, a silicon substrate may be used as the element substrate, and various elements may be provided thereon. In this case, field effect transistors may be used as various switches, and thus high speed driving becomes easy. Here, when the element substrate does not have transparency, the pixel electrode 118 may be made of aluminum or an additional reflecting layer may be formed, such that the element substrate is used for reflection type.

Further, in the above-mentioned embodiment, a twisted nematic (TN) liquid crystal is used. Instead, the liquid crystal may be a bi-stable type having memory effects, such as a BTN (bi-stable twisted nematic) type or ferroelectric type, a polymer dispersion type, or a GH (guest-host) type which a dye (guest) having anisotropic visible light absorbency in a long axis and a short axis of molecules is dissolved in a liquid crystal (host) having a predetermined molecular arrangement so that the dye molecules and the liquid crystal molecules are arranged in parallel.

Further, the configuration may be a vertical (homeotropic) alignment in which the liquid crystal molecules are arranged perpendicular to both substrates when no voltage is applied and parallel to both substrate when a voltage is applied, or may be a parallel horizontal alignment (homogeneous alignment) in which the liquid crystal molecules are arranged parallel to both substrates when no voltage is applied and perpendicular to both substrate when a voltage is applied. Accordingly, the present invention can be applied to various types of liquid crystals and alignment systems.

In the above description, the electro-optical device in which the liquid crystal is used as the electro-optical material is described. However, the present invention can be applied to a device which uses an EL (electronic luminescence) element, an electron emission element, an electrophoretic element, or a digital mirror element, or a plasma display, as long as it precharges the data lines before writing.

<Electronic Apparatus>

Next, an electronic apparatus which uses an electro-optical device according to the above-mentioned embodiment will be described.

<1: Projector>

Figure 9:
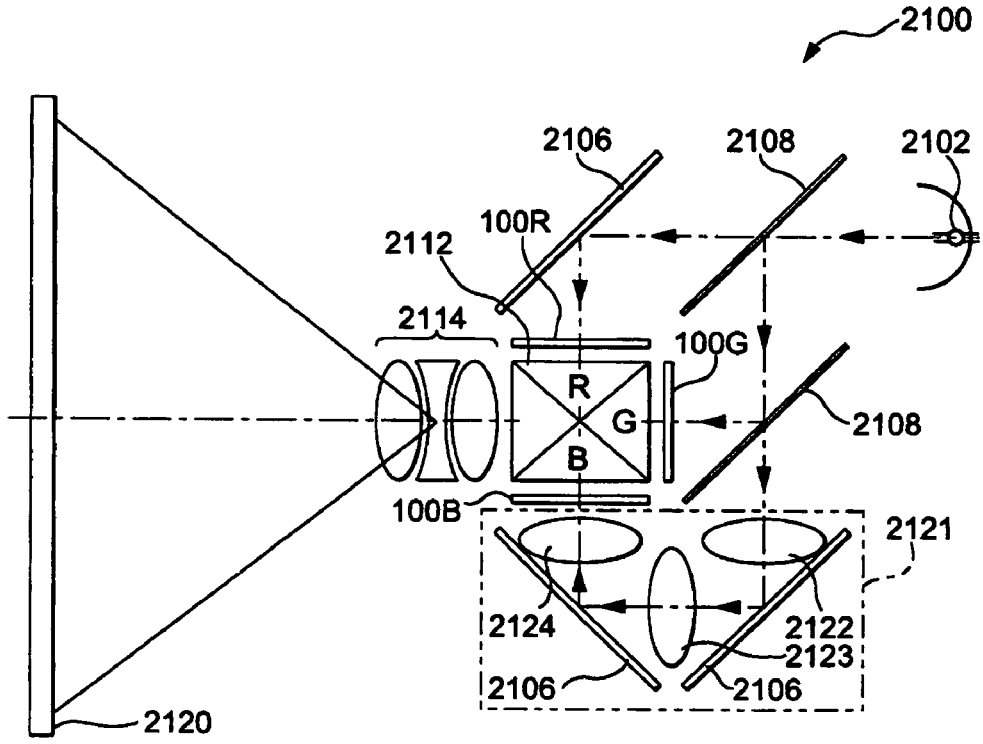
FIG. 9 is a cross-sectional view showing a configuration of a projector as an example of an electronic apparatus to which the liquid crystal display device according to the embodiment is applied.

First, a projector which uses the above-mentioned display panel 100 as a light valve will be described. FIG. 9 is a plan view showing a configuration of the projector. As shown in FIG. 9, the projector 2100 is provided with a lamp unit 2102 having a white light source, such as a halogen lamp, therein. Projection light emitted from the lamp unit 2102 is divided into three primary color light components of R (red), G (green), and B (blue) by three mirrors 2106 and two dichroic mirrors 2108, and the three primary color light components are introduced to light valves 100R, 100G; and 100B. Moreover, since the B light component has an optical path which is longer than that of the R light component or the G light component, the B light component is introduced via a relay lens system 2121 which has an incident lens 2122, a relay lens 2123, and an emission lens 2124 in order to prevent optical loss.

Figure 11:
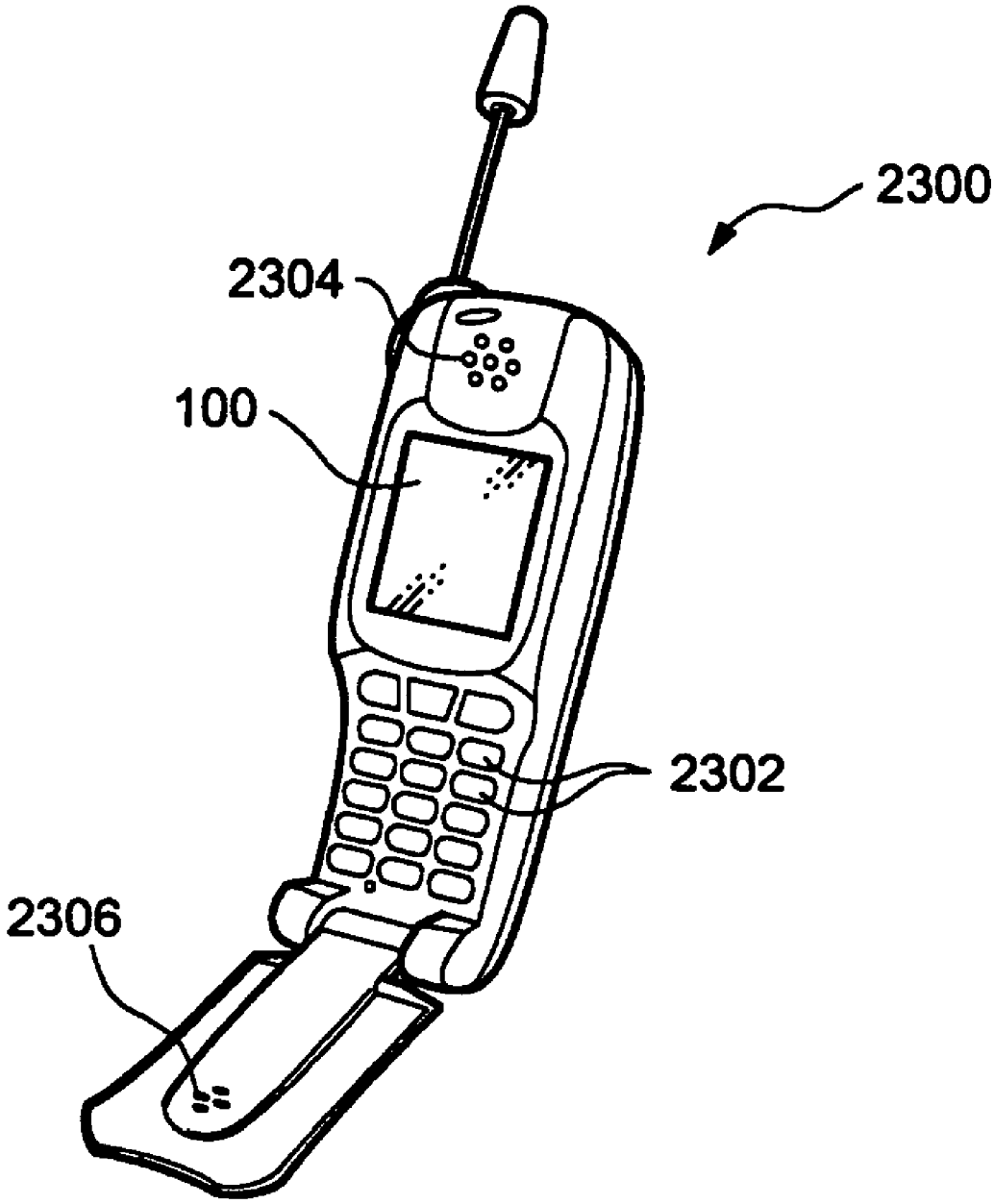
FIG. 11 is a perspective view showing a configuration of a cellular phone as an example of an electronic apparatus to which the liquid crystal display device according to the embodiment is applied.
Figure 12:
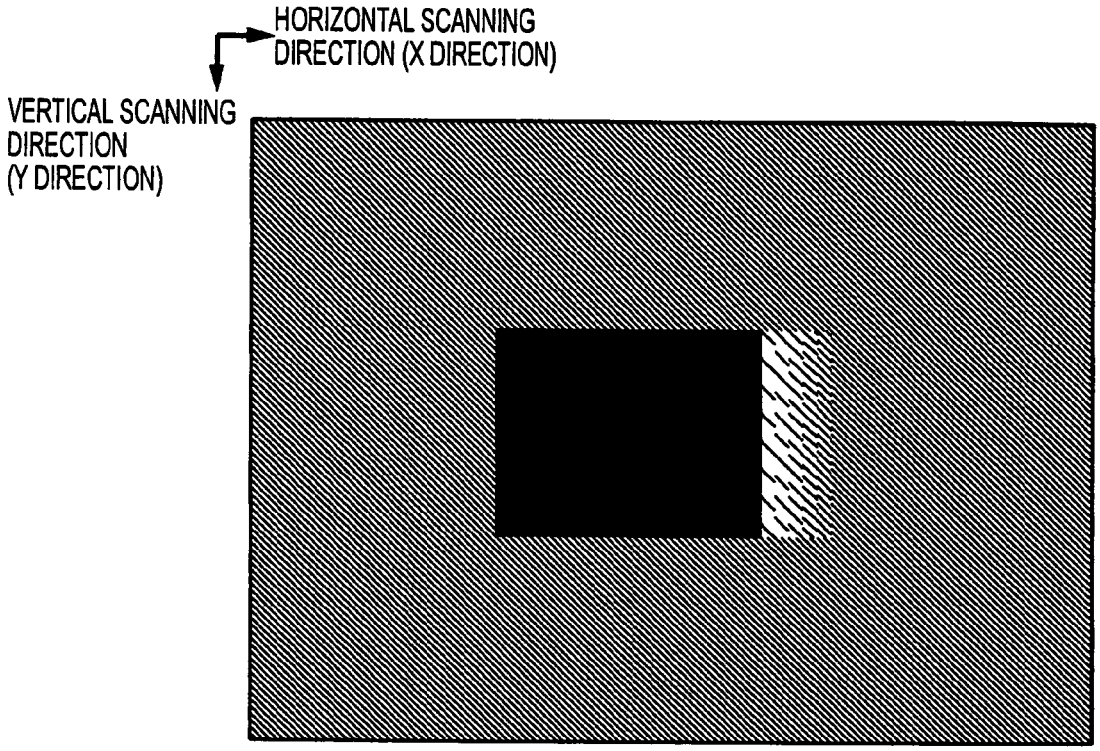
FIG. 12 is a diagram showing deterioration of the display quality caused by the horizontal crosstalk.

Here, the configuration of the light valves 100R, 100G and 100B is the same as that of the liquid crystal panel 100 corresponding to the above-mentioned embodiment and are driven by image signals corresponding to the respective colors of R, G and B, respectively, which are supplied from a processing circuit (not shown in FIG. 11). That is, in the projector 2100, three display panels 100 are provided in association with respective colors of R, G and B.

Light components modulated by the light valves 100R, 100G and 100B are incident on a dichroic prism 2112 from the three directions. In the dichroic prism 2112, the R light component and the B light component are reflected by 90 degrees, while the G light component passes through straight. After a color image is synthesized from these colors, the color image is projected onto a screen 2120 through a projection lens 2114.

Since the light components corresponding to the respective colors of R, G and B are incident on the light valves 100R, 100G and 100B, respectively, through the dichroic mirrors 2108, no color filter is provided as described above. The images transmitted from the light valves 100R and 100B are reflected by the dichroic mirror 2112 and are projected whereas the image transmitted from the light valve 100G is directly projected. Thus, the horizontal scanning direction by the light valves 100R and 100B is reversed with respect to the horizontal scanning direction by the light valve 100G, and thus the images from the light valves 100R and 100B the images are mirror-reversed.

<2: Mobile Personal Computer>

Figure 10:
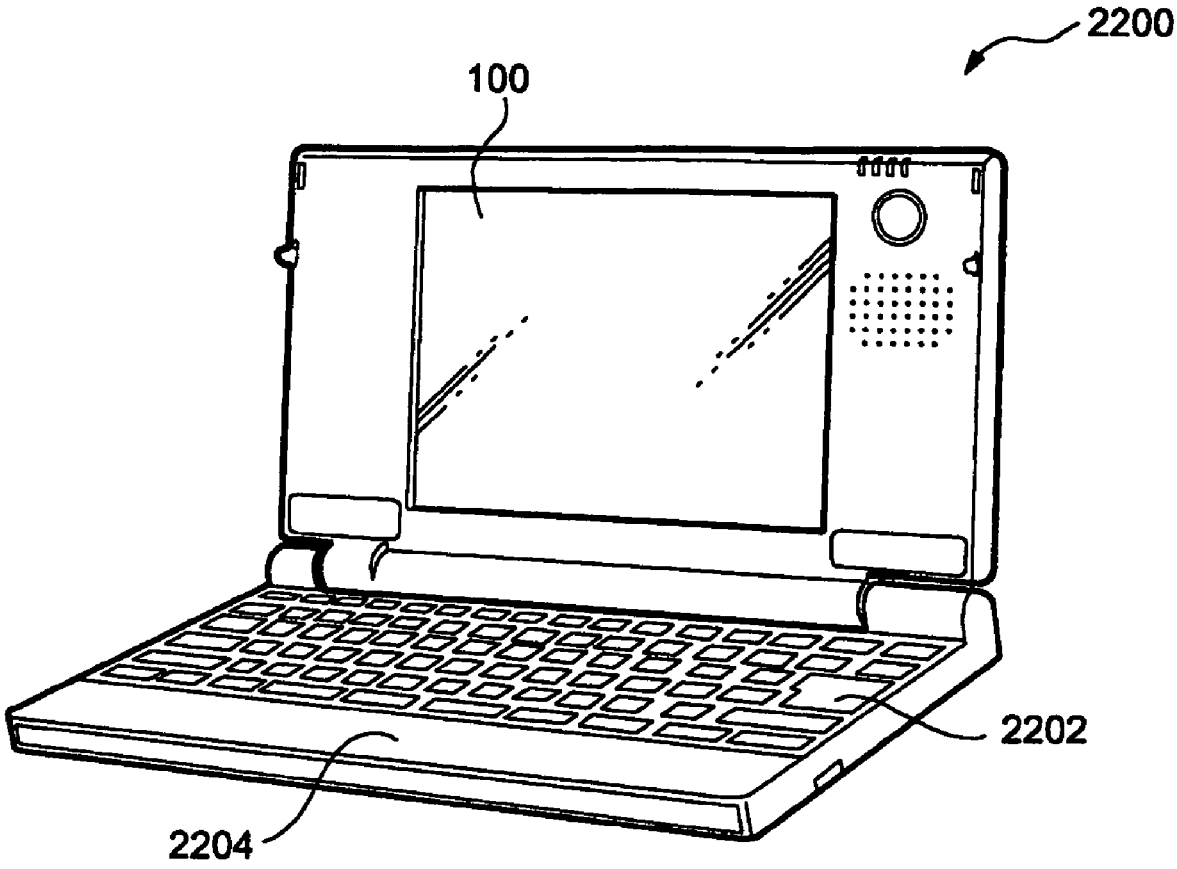
FIG. 10 is a perspective view showing a configuration of a personal computer as an example of an electronic apparatus to which the liquid crystal display device according to the embodiment is applied.

Next, an example in which the above-mentioned electro-optical device is applied to a mobile personal computer will be described. FIG. 10 is a perspective view showing a configuration of the personal computer. In FIG. 10, the computer 2200 is provided with a main body 2204 having a keyboard 2202 and a display panel 100 which is used as a display unit. The display panel 100 is provided with a backlight unit (not shown) at the back surface thereof to improve visibility.

<3: Cellular Phone>

In addition, an example in which the above-mentioned liquid crystal display device is applied to a display unit of a cellular phone will be described. FIG. 11 is a perspective view showing a configuration of the cellular phone. In FIG. 11, the cellular phone 2300 is provided with a plurality of operation keys 2302, an ear piece 2304, a mouthpiece 2306, and a display panel 100 which is used as a display unit. Moreover, the display panel 100 is also provided with a backlight unit (not shown) at the back surface thereof to improve visibility.

<Other Electronic Apparatuses>

In addition to the apparatuses shown in FIGS. 9, 10 and 11, examples of electronic apparatuses may include televisions, view-finder-type and monitor-direct-view-type video tape recorders, car navigation systems, pagers, electronic organizers, electronic calculators, word processors, workstations, videophones, digital still cameras, and devices provided with touch panels. And then, it is needless to say that the electro-optical device according to the above embodiment can be applied to these electronic apparatuses.

What is claimed is:

1. A circuit for driving an electro-optical device having a plurality of pixels, each pixel having a pair of a switching element and a pixel electrode formed at each intersection of a plurality of scanning lines and a plurality of data lines, the switching element being inserted so as to electrically switch between the data line and the pixel electrode, and the pixel electrode opposing a counter electrode with an electro-optical material interposed therebetween, the circuit for driving an electro-optical device comprising:

a scanning line driving circuit for sequentially selecting the scanning lines;

a data line driving circuit for, when one of the scanning lines is selected, supplying the data line with an image signal according to a gray scale level of the pixel corresponding to the intersection of the selected scanning line and data line; and a precharge circuit that: integrates, for some or all of the pixels of one row which are disposed along the selected scanning line, a difference between the gray scale level of each of the pixels corresponding to the intersection of the selected scanning line and a reference gray scale level previously set; and precharges, prior to supplying the data lines with image signals of the pixels corresponding to a next selected scanning line, the data lines with voltages corresponding to the integrated value.

2. The circuit for driving an electro-optical device according to claim 1, further comprising switches for supplying voltages corresponding to the integrated value to one end of the data lines when being turned on.

3. The circuit for driving an electro-optical device according to claim 1, further comprising:

image signal lines for inputting the image signals to the data line driving circuit; and a selector for selectively applying the image signals and a voltage corresponding to the integrated value.

4. The circuit for driving an electro-optical device according to claim 1, wherein the reference gray scale level corresponds to the difference between a maximum and a minimum among the gray scale levels of the pixels.

5. A method of driving an electro-optical device having a plurality of pixels, each pixel having a pair of a switching element and a pixel electrode formed at each intersection of a plurality of scanning lines and a plurality of data lines, the switching element being inserted so as to electrically switch between the data line and the pixel electrode, and the pixel electrode opposing a counter electrode with an electro-optical material interposed therebetween, in which the scanning lines are sequentially selected, and when one of the scanning lines is selected, an image signal according to a gray scale level of the pixel corresponding to the intersection of the selected scanning line and data line is supplied to the data lines, the method comprising:

a step of integrating, for some or all of the pixels of one row which are disposed along the selected scanning line, a difference between the gray scale level of each of the pixels corresponding to the intersection of the selected scanning line and a reference gray scale level previously set; and a step of, prior to supplying the data lines with image signals of the pixels corresponding to a next selected scanning line, precharging the data lines with voltages corresponding to the integrated value.

6. An electro-optical device having a plurality of pixels, each pixel having a pair of a switching element and a pixel electrode formed at each intersection of a plurality of scanning lines and a plurality of data lines, the switching element being inserted so as to electrically switch between the data line and the pixel electrode, and the pixel electrode opposing a counter electrode with an electro-optical material interposed therebetween, the electro-optical device comprising:

a scanning line driving circuit for sequentially selecting the scanning lines;

a data line driving circuit for, when one of the scanning lines is selected, supplying the data line with an image signal according to a gray scale level of the pixel corresponding to the intersection of the selected scanning line and data line; and a precharge circuit that:

integrates, for some or all of the pixels of one row which are disposed along the selected scanning line, a difference between the gray scale level of each of the pixels corresponding to the intersection of the selected scanning line and a reference gray scale level previously set; and precharges, prior to supplying the data lines with image signals of the pixels corresponding to a next selected scanning line, the data lines with voltages corresponding to the integrated value.

7. An electronic apparatus comprising an electro-optical device for a display unit as claimed in claim 6.

* * * * *